United States Patent [19]

Wigington

[11] Patent Number: 4,813,515

[45] Date of Patent: Mar. 21, 1989

[54] GUTTER GUARD DEVICE

[76] Inventor: Jerry Wigington, Salem Woods, Salem, S.C. 29676

[21] Appl. No.: 209,015

[22] Filed: Jun. 20, 1988

[51] Int. Cl.[4] ..... E04D 13/04; E06C 7/48

[52] U.S. Cl. ..... 182/214; 248/48.2; 52/11

[58] Field of Search ..... 182/214, 107, 230; 52/11; 248/48.2

[56] References Cited

U.S. PATENT DOCUMENTS

| | | | |
|---|---|---|---|
| 3,550,381 | 12/1970 | South | 248/48.2 |
| 3,853,202 | 12/1974 | Jarboe | 182/214 |
| 4,185,421 | 1/1980 | Robinson | 182/214 |
| 4,553,356 | 11/1985 | Pepper | 52/11 |
| 4,601,365 | 7/1986 | Davis | 182/214 |
| 4,696,131 | 9/1987 | Schreffler | 248/48.2 |
| 4,714,136 | 12/1987 | Morin | 182/214 |

*Primary Examiner*—Reinaldo P. Machado
*Attorney, Agent, or Firm*—Cort Flint

[57] ABSTRACT

A gutter guard device (A) is disclosed which includes an elongated, tubular frame (B) formed by a rolled and stamped sheet metal construction. The stamping process defines transverse bracing webs (30) and vertical flanges (32) which brace between front and rear tubular braces (10,14). Pivotal legs (22,24) carried by frame (B) allow for easy installation of the guard in a gutter (12). Spaced indicator brackets (26,28) assist the support of the front of the frame while providing visibility to determine location of the frame from the ground. A ladder may be leaned against the gutter between the indicator tabs.

19 Claims, 2 Drawing Sheets

GUTTER GUARD DEVICE

BACKGROUND OF THE INVENTION

The invention relates to a device for reinforcing and protecting a gutter with a ladder leaning against the gutter. In numerous instances, it is needed to lean an extension or other type ladder against a gutter for access to surrounding areas. The conventional gutter made from light weight aluminum or plastic cannot support this weight.

U.S. Pat. No. 4,601,365 discloses a device inserted in a gutter for supporting a ladder. While the device is satisfactory as a support, it is often awkward to insert into the gutter due to the long downward extending legs and the necessity of tightly fitting the front brace in the gutter lip. Further, once inserted, it is difficult to move and to locate in the gutter from the ground so that accurate ladder placement may be had. Other ladder supports are shown in U.S. Pat. Nos. 4,714,136; 4,696,131; 4,185,421; and 3,853,202. However, these supports related to quite different devices do not overcome the noted deficiencies.

Accordingly, an important object of the invention is to provide a gutter guard for reinforcing and protecting a gutter which is lightweight, strong, and may be readily moved and seen in the gutter for ladder placement from the ground.

Another object of the invention is to provide a gutter guard for reinforcing a gutter against which a ladder is leaned which is lightweight and simple in construction facilitating packaging in a flat configuration and simple setup and insertion in the gutter.

Still another object of the invention is to provide a strong yet lightweight gutter guard for reinforcing and protecting a gutter against which a ladder is leaned which fits a variety of gutter types.

SUMMARY OF THE INVENTION

The above objectives are accomplished according to the invention by providing a device for protecting a gutter while a ladder is supported against the gutter which includes an elongated frame having a front brace for bracing against a front portion of the gutter and a rear brace for bracing against a rear portion of the gutter. Transverse braces extend between the front brace and the rear brace for bracing the front and rear braces against the front and rear portions of the gutter. Easily positionable rear supports are carried by the frame for supporting the frame in an elevated brace position within the gutter. Spaced indicators are carried by the frame extending past the front portion of the gutter which are visible from a ground position for indicating the location of the frame in the gutter for placement of a ladder. Preferably, the rear support means includes a first movable leg carried near one end of the frame and a second movable leg carried near a second end of the frame. The first and second legs have a first folded position facilitating placement in the interior of the gutter and a second support position in which the legs support the frame in the bracing position. Preferably, the frame includes a front brace with a rolled tubular construction which includes at least a top wall, a front wall bent from the top wall, and a bottom wall bent from the front wall. The rear brace has a rolled tubular construction which includes a top wall, a front wall bent from the top wall, a bottom wall bent from the front wall, and at least a partial back wall bent from the bottom wall. The transverse braces include a horizontal web and a vertical flange bent down from the web. The vertical flange extends between the back walls of the front and rear braces. In this way, a very lightweight construction is provided by which the pivotal rear support legs can be easily installed and moved in the gutter. The folding legs also facilitate shipping as a flat package. The indicators on the front of the frame may be advantageously constructed as support tabs which engage the front of the gutter and support the front of the frame in the bracing position. By extending the tabs over the front of the gutter, they may be seen from the ground and provide indicators so that the guard may easily be seen from the ground. The tubular frame is lightweight for shipping and installation, but strong enough for supporting a ladder against the gutter.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Referring now in more detail to the drawings, a device, designated generally as A, is illustrated for reinforcing and protecting a gutter while a ladder is supported against the gutter. The device comprises an elongated frame B having a front brace 10 for bracing against a front portion of the gutter 12 and a rear brace 14 for bracing against a rear portion of the gutter. Transverse brace means 16 extend between front brace 10 and rear brace 14 for bracing the front and rear braces against the front and rear portions of the gutter. Rear support means C is carried by the frame for supporting the frame in an elevated brace position within the gutter. Spaced indicator means D are carried by the frame extending past a front portion **12*a*** of the gutter visible from a ground position for indicating the location of frame B in the gutter for placement of a ladder L.

Figure 1:
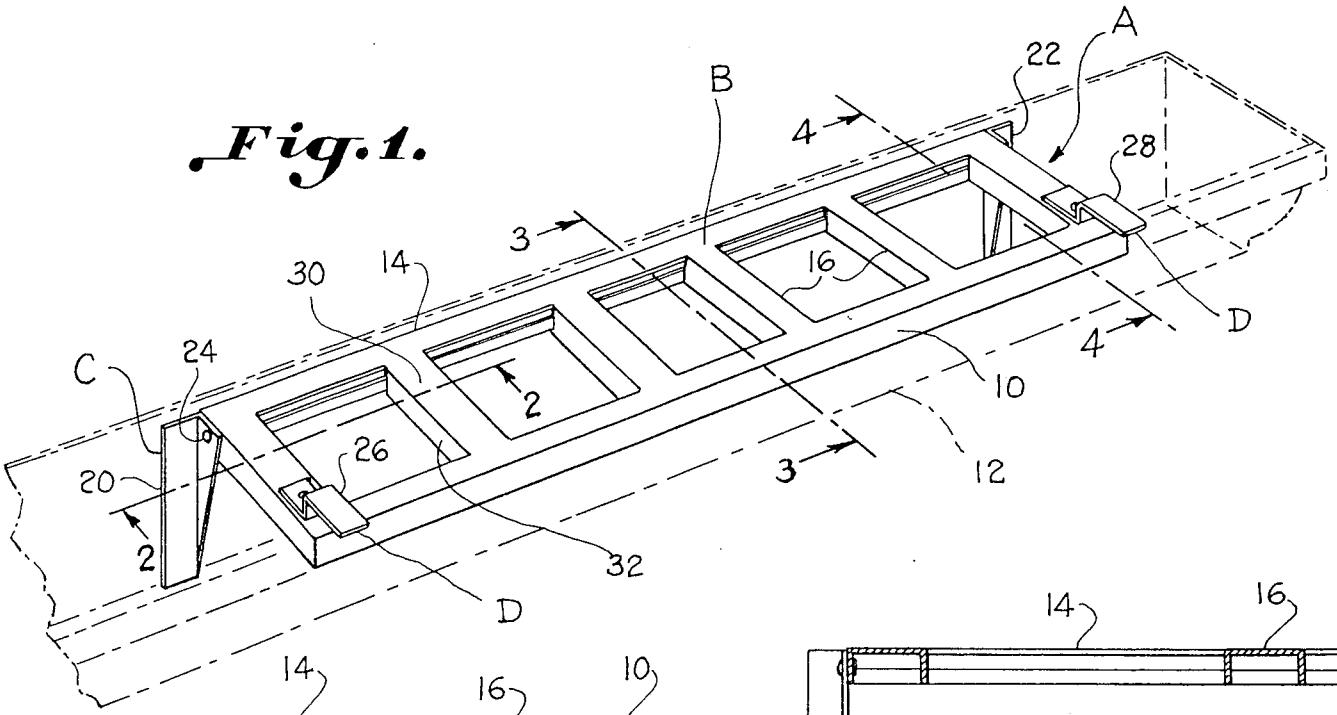
FIG. 1 a perspective view illustrating the gutter guard device of the present invention installed within a gutter for reinforcing and protecting the gutter in the support of a ladder.
Figure 5:
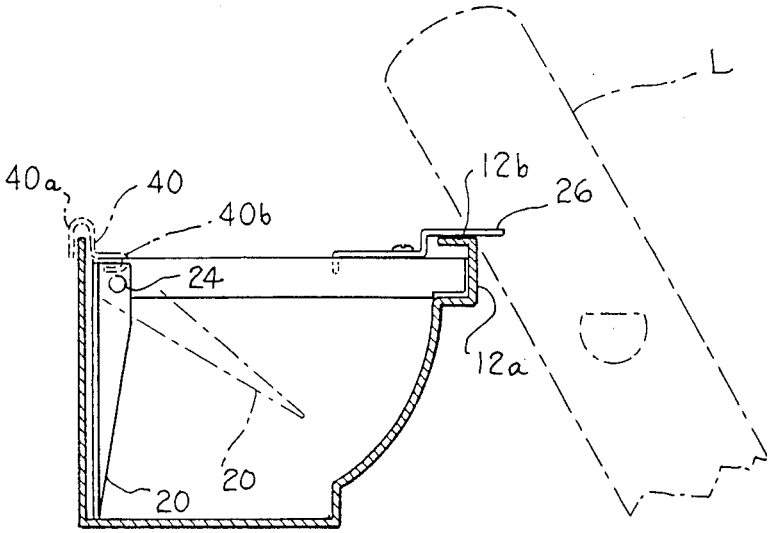
FIG. 5 is a view of the gutter taken in section from a first end of the gutter guard installed in the gutter with a ladder leaning against the reinforced gutter.

Rear support means C includes a first movable leg 20 carried near a first end of the frame and a second movable leg 22 carried near a second end of the frame. Preferably, movable legs 20,22 are movable from a folded position (see partially folded position in dotted lines of FIG. 5), in which the frame may easily be inserted into the gutter, to a support position in which the frame is in an elevated brace position (FIGS. 1 and 5). Preferably, the legs are mounted to frame B and are movable in a pivotal movement provided by pivot means 24 which pivotally attach the first and second movable legs to the first and second ends of frame B. The first and second legs pivot between the folded and support positions.

The spaced indicator means D include a first tab 26 carried by the frame and a second tab 28 carried by the frame. The first and second tabs are spaced apart a distance equal to or greater than the width of a conventional extension ladder, and rest on an upper edge 12*b* of the front portion of the gutter to support front brace 10 and the frame in the elevated brace position. The ladder may be leaned against the gutter between the tabs with bracing by the frame supported in the gutter.

Figure 2:
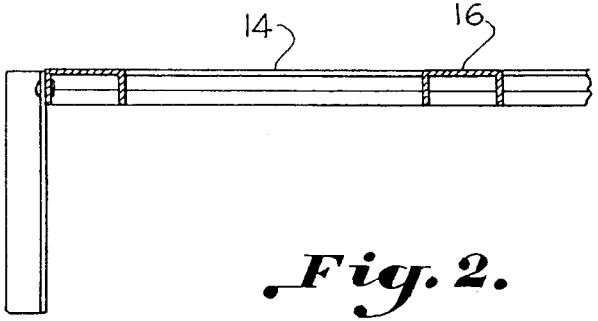
FIG. 2 is a sectional view taken along line 2—2 of FIG. 1.
Figure 3:
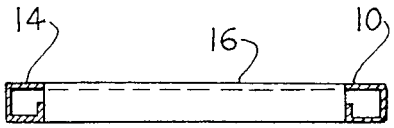
FIG. 3 is a sectional view taken along line 3—3 of FIG. 1.

The transverse brace means 16 include a plurality of transverse braces having a horizontal web 30 and at least one generally vertical flange 32 generally orthogonal to the web. Preferably, two such vertical flanges are provided for each web 30 as can best be seen in FIG. 2. The front brace 10 has a tubular construction defined by a top wall 10*a*, front wall 10*b*, bottom wall 10*c*, and at least a partial back wall 10*d*. Rear brace 14 has a tubular construction defined by a top wall 14*a*, front wall 14*b*, bottom wall 14*c*, and at least a partial back wall 14*d*. Transverse braces 16 extend between the front and rear braces abutting against partial back walls 10*d* and 14*d* in a bracing relation. Preferably, the entire frame is made from a sheet metal stamped construction, although other materials and methods may also possibly be used.

Figure 4:
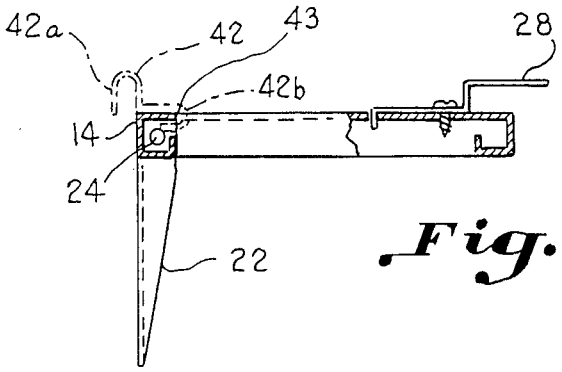
FIG. 4 is a sectional view taken along line 4—4 of FIG. 1.
Figure 6:
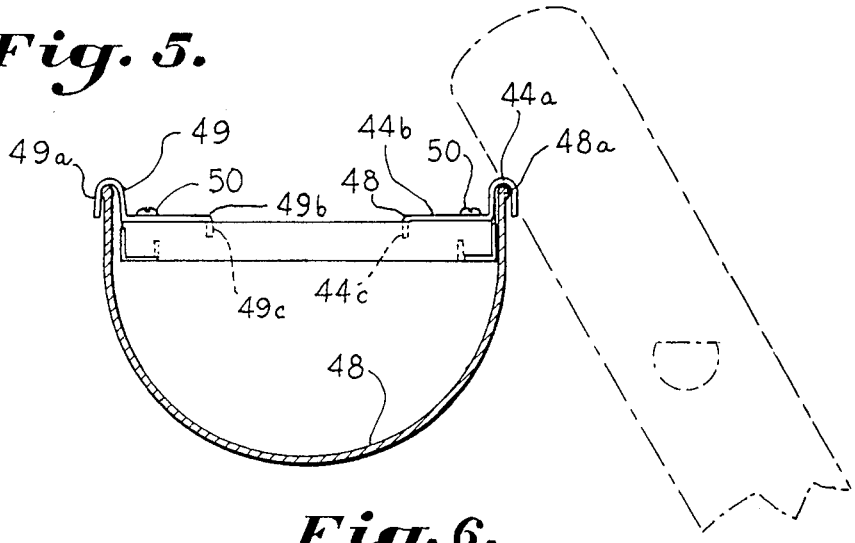
FIG. 6 is a view with an alternate type of gutter taken in section having an alternate embodiment of a gutter guard device constructed in accordance with the invention installed in the gutter for supporting a ladder.

Support means for frame B in a brace position within te gutter further includes indicator tabs 26,28 in the form of generally S-shaped front bracket means carried on the frame for securing a front of the frame to the front portion 12*a* of the gutter. Rear bracket means 40,42 may be carried on the frame B for securing the frame to a rear portion 12*c* of the gutter in addition, or in lieu of legs 20,22. Each rear bracket includes a gutter hook 40*a*,42*a* which hooks over the upper edge 12*d* of gutter 12 to support the gutter guard frame, and a frame hook 40*b*,42*b* which hooks over an edge 43 of rear brace 14, as can be seen in FIGS. 4 and 5. In the case of plastic or vinyl gutters, the gutter typically has a round configuration, as can best be seen in FIG. 6. In this case, front bracket means 44 may be used as front support means to attach the front of frame B over the front edge 48*a* of vinyl gutter 48. For this purpose, a front hook 44*a* is provided for each front bracket 44 which hooks over the front edge 48*a*. The overhanging front of hook 44*a* may in this case serve as indicator means extending past the front portion of the gutter being visible from the ground for determining the position of the frame in the gutter. A shank 44*b* is attached to a web 30 of frame B having a downturned tab 44*c* received in a slot 48 in web 30, as can best be seen in FIG. 6. A rear bracket 49 having a hook 49*a*, shank 49*b*, and tab 49*c* similarly disposed attaches frame B to a rear gutter edge. Each support bracket 26,28,44 and 49 may be attached to metal frame B by using conventional sheet metal screws 50.

In accordance with the method of the invention, frame B is produced in a lightweight construction yet still having strength for protecting a gutter while a ladder is leaned against the gutter by the following steps. A piece of sheet metal is first provided. A plurality of rectangular openings 60 are stamped and cut in the metal sheet to define the plurality of webs 30 extending transversely between front and rear strips of the sheet metal from which the front and rear braces 10 and 14 are subsequently formed by roll bending of the respective walls. A cut side strip is left attached only to webs 30 extending outwardly from one side of each web from edges of the rectangular opening. The side strips are then bent downwardly into vertical flanges 32. The front and rear strips are formed into tubular front and rear braces by bending the strips to define a respective top wall, front wall, and bottom wall at each of the front and rear braces. The vertical flanges brace between the front and rear tubular braces by bending the cut side strip downwardly from each web. At least a partial back wall 10*d*,14*d* is formed for each of the front and rear tubular braces by bending each strip of sheet metal upwardly from the bottom walls, and contacting the back walls with the transverse vertical flange for bracing the front and rear braces with a ladder leaning against the gutter.

While a preferred embodiment of the invention has been described using specific terms, such description is for illustrative purposes only, and it is to be understood that changes and variations may be made without departing from the spirit or scope of the following claims.

What is claimed is:

1. A device for protecting a gutter while a ladder is supported against the gutter, comprising:

an elongated frame having a front brace for bracing against a front portion of said gutter and a rear brace for bracing against a rear portion of said gutter;

transverse brace means extending between said front brace and said rear brace for bracing said front and rear braces against said front and rear portions of said gutter;

rear support means carried by said frame for supporting said frame in an elevated brace position within said gutter; and spaced indicator means carried by said frame extending past said front portion of said gutter visible from a ground position for indicating the location of frame in said gutter for placement of a ladder.

2. The device of claim 1, wherein said rear support means includes a first movable leg carried near a first end of said frame and a second movable leg carried near a second end of said frame, said movable legs being movable from a folded position in which said frame may easily be inserted into said gutter to a support position in which said frame is in said elevated brace position.

3. The device of claim 2 including pivot means pivotally attaching said first and second movable legs to said first and second ends of said frame, and said first and second legs pivoting between said folded and support positions.

4. The device of claim 1, wherein said spaced indicator means includes a first tab carried by said frame and a second tab carried by said frame, said first and second tabs being spaced and resting on an upper edge of said front portion of said gutter to support said front brace and said frame in said elevated brace position.

5. The device of claim 4, wherein said first and second tabs are spaced a distance apart generally greater than the width of a ladder supported against said gutter so that said ladder may be leaned against said gutter between said tabs with bracing by said frame supported in said gutter.

6. The device of claim 1, wherein said transverse brace means includes a plurality of transverse braces having a horizontal web and at least one generally vertical flange generally orthogonal to said web.

7. The device of claim 6, wherein said frame includes:

said front brace having a tubular construction defined by a top wall, front wall, bottom wall, and at least a partial back wall;

said rear brace having a tubular construction defined by a top wall, front wall, bottom wall, and at least a partial back wall; and said transverse braces extending between said front and rear braces.

8. The device of claim 1, wherein said front brace has a rolled tubular construction which includes a top wall, a front wall bent from said top wall, a bottom wall bent from said front wall, and at least a partial back wall bent from said bottom wall; said rear brace has a rolled tubular construction which includes a top wall, a front wall bent from said top wall, a bottom wall bent from said front wall, and at least a partial back wall bent from said bottom wall; and said transverse flange includes a horizontal web and a vertical flange bent down from said web, said vertical flanges extending between said partial walls of said front and rear braces.

9. A device for protecting a gutter while a ladder is supported against the gutter, comprising:

a frame having a front brace with a rolled tubular construction which includes at least a top wall, a front wall bent from said top wall, and a bottom wall bent from said front wall;

a rear brace having a rolled tubular construction which includes a top wall, a front wall bent from said top wall, a bottom wall bent from said front wall, and at least a partial back wall bent from said bottom wall;

transverse flanges including horizontal webs and vertical flanges bent down from said webs, said vertical flanges extending between said partial walls of said front and rear braces; and support means carried by said frame for supporting said frame in an interior trough of said gutter in a bracing position with said front brace braced against a front portion of said gutter and said rear brace braced against a rear portion of said gutter for supporting a ladder leaning against said gutter.

10. The device of claim 9, wherein each said front and rear braces further includes at least a partial back wall bent from said bottom wall, said vertical flanges of said transverse flanges extending between said back walls to brace said device in said gutter against said leaning ladder.

11. The device of claim 9, wherein said support means includes:

a first movable leg carried by said frame near one end of said frame and a second movable leg carried near a second end of said frame, and said first and second legs having a folded position facilitating placement in said interior of said gutter and a support position in which said legs support said frame in said bracing position.

12. The device of claim 9, wherein said support means includes front bracket means carried on said frame for securing a front of said frame to said front portion of said gutter, and rear bracket means carried on said frame for securing said frame to a rear portion of said gutter.

13. The device of claim 12, wherein said front bracket means includes indicator means extending past said front portion of said gutter being visible from the ground for determining the position of said frame in said gutter.

14. The device of claim 12, wherein said front and rear bracket means are detachable.

15. The device of claim 9 wherein, said support means includes:

front bracket indicator means carried near a front of said frame for engaging a front portion of said gutter for supporting said frame in said gutter and for providing an indication visible from the ground of the location of said frame in said gutter.

16. A device for protecting a gutter while a ladder is supported against the gutter, comprising:

an elongated frame having a front brace for bracing against a front portion of said gutter and a rear brace for bracing against a rear portion of said gutter;

transverse brace means extending between said front brace and said rear brace for bracing said front and rear braces against said front and rear portions of said gutter;

rear support means carried by said frame for supporting said frame in an elevated brace position within said gutter;

spaced indicator means carried by said frame extending past said front portion of said gutter visible from a ground position for indicating the location of frame in said gutter for placement of a ladder, and a first movable leg carried by said frame near one end of said frame and a second movable leg carried near a second end of said frame, and said first and second legs having a first folded position facilitating placement in said interior of said gutter and a second support position in which said legs support said frame in said bracing position.

17. The device of claim 16 including:

pivot means for pivotally attaching said first and second legs to said frame for pivotal movement between said foleed and support positions.

18. A method of producing a lightweight gutter brace for protecting a gutter while a ladder is leaned against the gutter, comprising the steps of:

providing a piece of sheet metal;

stamping and cutting a plurality of rectangular openings in said metal sheet to define a plurality of webs extending transversely between front and rear strips of said sheet metal;

forming a cut side strip attached only to said webs extending outwardly from one side of each web free from edges of said rectangular opening;

forming said front and rear strips into tubular front and rear braces by bending said strips to define a respective top wall, front wall, and bottom wall at each of said front and rear braces; and forming a vertical flange for bracing between said front and rear tubular braces by bending said cut side strip downwardly from each said web.

19. The method of claim 18 including forming at least a partial back wall for each of said front and rear tubular braces by bending each said strip of sheet metal upwardly from said bottom walls, and contacting said back walls with said transverse vertical flange for bracing said front ant rear braces with a ladder leaning against said gutter.

* * * * *